United States Patent [19]

Gallo

[11] Patent Number: 4,744,196

[45] Date of Patent: May 17, 1988

[54] DEVICE FOR INTERLOCKING TONGUE-AND-GROOVE TYPE BAG

[76] Inventor: Michael S. Gallo, 1310 N. Memorial Dr., Racine, Wis. 53404

[21] Appl. No.: 107

[22] Filed: Jan. 2, 1987

[51] Int. Cl.[4] ..... B65B 7/06

[52] U.S. Cl. ..... 53/371; 53/390; 53/570

[58] Field of Search ..... 53/457, 469, 476, 480, 53/481, 570, 371, 376; 383/63; 53/390

[56] References Cited

U.S. PATENT DOCUMENTS

| | | | |
|---|---|---|---|
| 3,744,211 | 7/1973 | Titchenal | 53/570 X |
| 4,199,845 | 4/1980 | Ausnit . | |
| 4,249,982 | 2/1981 | Ausnit . | |
| 4,268,938 | 5/1981 | Walchli . | |
| 4,290,467 | 9/1981 | Schmidt . | |
| 4,490,595 | 1/1985 | Lems | 53/570 X |
| 4,514,962 | 5/1985 | Ausnit | 53/570 X |
| 4,517,788 | 5/1985 | Scheffers | 53/570 X |
| 4,654,878 | 3/1987 | Lems | 383/63 X |
| 4,665,552 | 5/1987 | Lems et al. | 53/469 X |

*Primary Examiner*—Robert L. Spruill
*Assistant Examiner*—Steven P. Weihrouch
*Attorney, Agent, or Firm*—Arthur J. Hansmann

[57] ABSTRACT

A device having two opposed surfaces with a minimum spacing therebetween for pressing together the tongue-and-groove strips of a bag when the bag is slid across the surfaces. There is a larger spacing between the surfaces for the lead-in of the bag between the other surfaces. The surfaces are on two cantilever type of arms for entry and maneuvering of the bag.

11 Claims, 3 Drawing Sheets

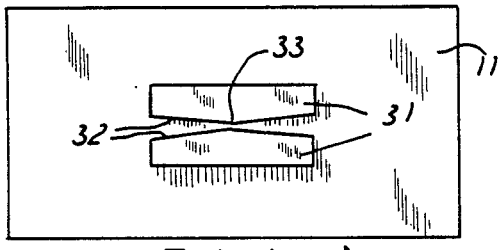
FIG. 4
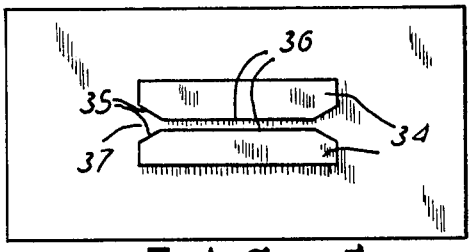
FIG. 5
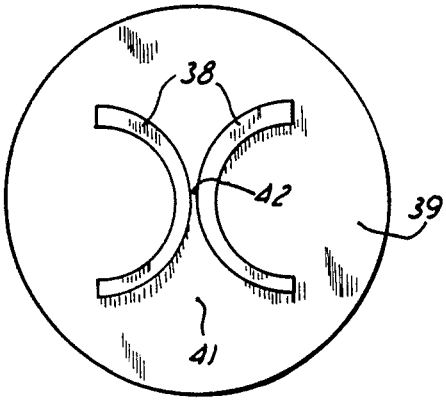
FIG. 6
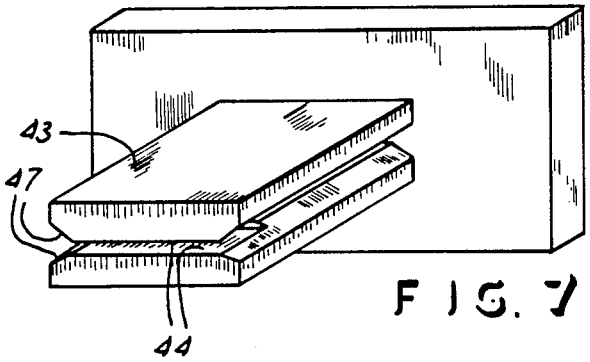
FIG. 7
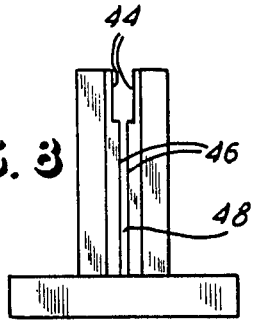
FIG. 8
FIG. 10
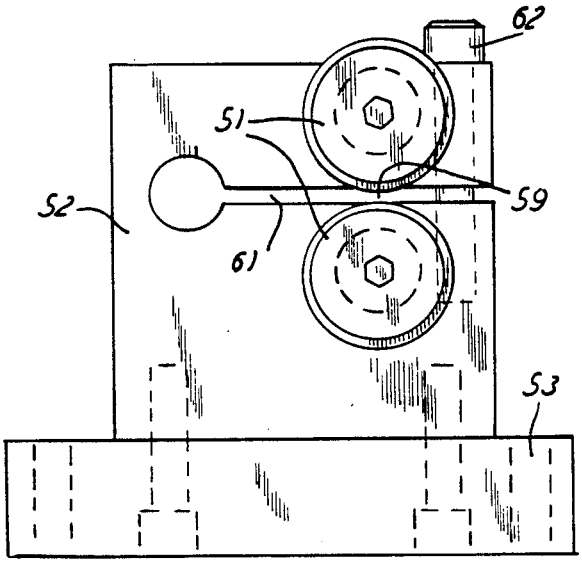
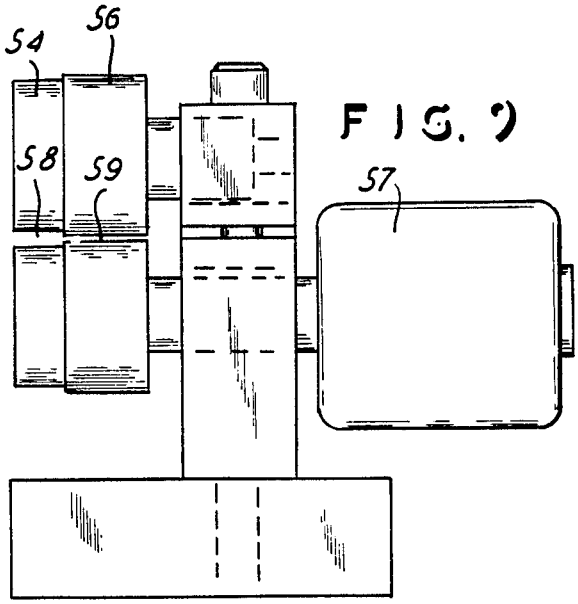
FIG. 9

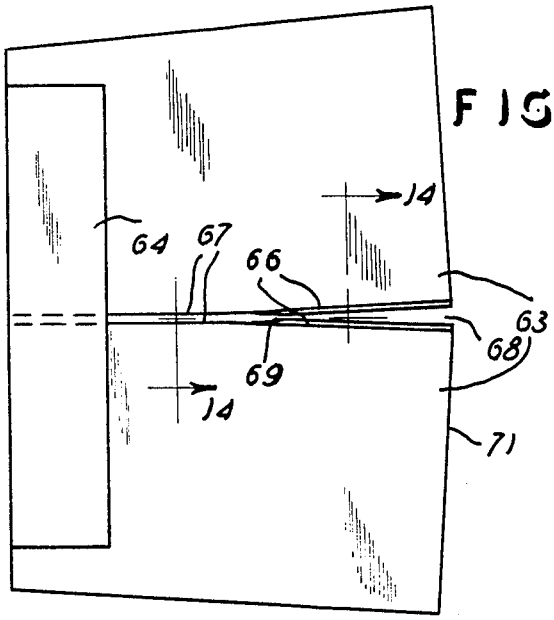
FIG. 11
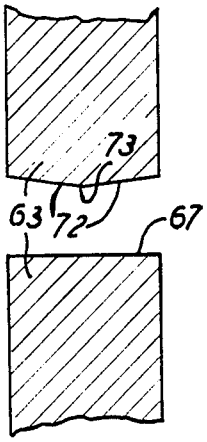
FIG. 14
FIG. 12
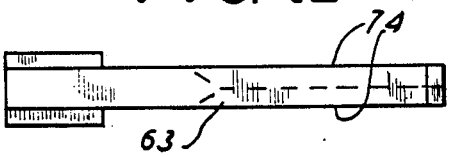
FIG. 13
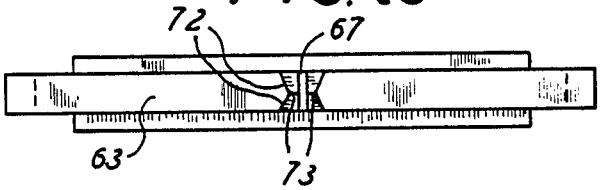
FIG. 15
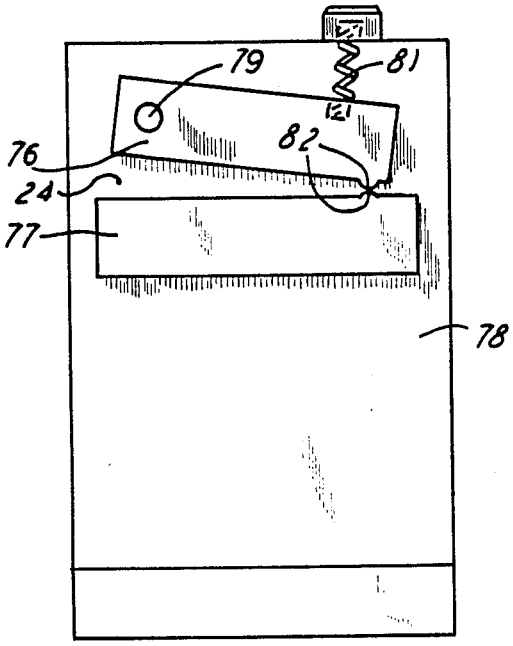

DEVICE FOR INTERLOCKING TONGUE-AND-GROOVE TYPE BAG

This application relates to a device for interlocking the sealing strips of a plastic bag, such as the bag having a tongue-and-groove type of sealing strips and useful for bagging items for industry, commerce, household, and the like applications.

BACKGROUND OF THE INVENTION

Plastic bags are commonly known and used for bagging small items, such as retail and commercial items and sandwich and like food items and the like. These bags commonly include a sealing strip of the tongue-and-groove type which interlocks for rendering the bag air tight. This type of bag commonly has a protruding strip extending across the mouth or opening of the bag, and there is a receiving and mating strip extending across the mouth of the bag opposite from the first strip, such that the two strips can be pressed toward each other into a sealed tongue-and-groove or mating relationship when pressure is applied from one end of the strips and continuously therealong to the other end of the strips. In present day common practice, this type of tongue-and-groove sealing bag is commonly sealed or has its strips interlocked by having a person run his or her fingers along the strips for joining the mating strips together. However, this frequently results in a misalignment of the tongue-and-groove sections, such that they do not actually interlock or mate, and then the bag is not sealed as desired. Further, this type of attempt to manually seal the bag requires careful attention and effort for aligning the strips and then exerting the correct pressure and it requires the time for aligning the strips and then running the fingers along the strips to effect the final interlocking or sealing.

The present invention provides a device which is utilized for effecting the sealing of the interlocking tongue-and-groove type of bag strips, and it accomplishes this by an inexpensive, easily manufactured, easily operated, and small and simplified device used in either a home or industrial application. It should of course be understood that in an industrial application, these types of plastic bags are commonly used for containing various goods, such as a number of small parts, and it is therefore required that the assembly line be established for sealing the bag after the goods are inserted, and this is tedious and time consuming when done manually as in the common practice of today.

U.S. Pat. No. 4,191,230 shows one type of a plastic bag and, for the present invention, it shows a tongue-and-groove type of the sealing strips which can be utilized on bags which can be sealed by the device of the present invention. U.S. Pat. No. 4,199,845 shows a bag strip sealing device which has two opposed and oppositely facing surfaces through which the sealing strip can be moved for purposes of joining the strips together. However, that device does not show a lead-in or opening in the unit for purposes of entry of the bag strips, and more particularly, it does not show that the two opposing surfaces than converge along their lengths so that they can progressively urge the tongue-and-groove strips into mating relationship. Importantly, the last mentioned patent does not show a device which receives the strip end of the plastic bag which can then be slid relative to the device, for the closing purposes mentioned, in that, the patent does not show extending arms in cantilever form, as in the present invention, for receiving the bag and sliding it between the arms. U.S. Pat. No. 4,249,982 shows the sealing strips of a bag joined by two rollers which are arranged only in an industrial environment in that it does not propose that a single bag be inserted between the rollers, as in the present invention, and, it shows rollers which preclude the slipping of the bag between the rollers in the axial direction of the rollers, as in the present invention. Likewise, the same limitations appear in U.S. Pat. No. 4,268,938 where rollers are shown, but the bag cannot be slid axially of the rollers to a position between the rollers, for the sealing function, as in the present invention. At most, the rollers in the latter patent require separate maneuvering of an upper roller down into engagement position with a lower roller for purposes of the sealing, and the present invention does not require any additional laborious maneuvering. Finally, U.S. Pat. No. 4,290,467 also shows rollers which run along sealing strips of a bag, but, again, the rollers are not arranged for insertion of the bag from the ends of the rollers and into position for sealing.

Accordingly, the present invention differs from the prior art in that it provides for the ready insertion of the sealing strips of an individual or discrete plastic bag between two opposed surfaces which bear inwardly on the bag and along the strips thereof for purposes of joining the strips into interlocked or mating position, and this is all accomplished by one continuous sweep of the bag into the device and therealong for the final desired sealing of the bag.

Still further, the present invention is disclosed in several species, and these species have the aforementioned advantages and features, and, in addition, there is the feature of accomodating plastic bags of different thicknesses across the mating strips thereof, such as for large or heavy bags and for small or lighter bags. In fact, certain of the species disclosed herein are particularly made for accomodating bags of two different thicknesses, and other species disclosed herein are made for accomodating bags of different thicknesses, since the device is capable of elastic movement or of being spring-loaded so that the opposed sealing surfaces move toward and away from each other for accomodating the different thicknesses in achieving the sealing function.

BRIEF DESCRIPTION OF THE DRAWINGS

FIGS. 4, 5, and 6 are front elevational views of other embodiments of the device of this invention.

FIG. 7 is a front perspective view of another embodiment of the device of this invention.

FIG. 8 is an end elevational view of the device shown in FIG. 7.

FIGS. 9 and 10 are side and front elevational views, respectively, of another embodiment of the device of this invention.

FIGS. 11, 12 and 13 are respectively side, end, and front views of another embodiment of the device of this invention.

FIG. 14 is an enlarged sectional view taken along the line 14–14 of FIG. 11.

FIG. 15 is a front elevational view of another embodiment of the device of this invention.

DETAILED DESCRIPTION OF THE PREFERRED EMBODIMENTS

The drawings shows various species of this invention, all of the species being inter-related in that they present opposing surfaces having a maximum dimension or gap for insertion of the bag, and they then have a minimum dimension or gap for the sealing of the bag when the sealing strips are slipped through that minimum dimension or gap. In this regard, the minimum dimension or gap may be achieved by means of two parallel surfaces spaced-apart and facing each other, or by two angulated surfaces, each of which comes to a line therealong, and with those surfaces facing each other, or by two rollers or cylindrical surfaces, or by two surfaces which are spring-urged toward each other. Also, the device can be arranged so that the minimum gap is presented in two dimensions in one device, for receiving large and small bags of at least the two different thickneses along their sealing strips. Still further, the devices may have arcuate surfaces spaced from each other for receiving the sealing strips therebetween, and the device may also have movable arms carrying the surfaces and with the arrangement being such that the arms can be adjustably positioned relative to each other for accomodating bags of different thicknesses.

Figure 1:
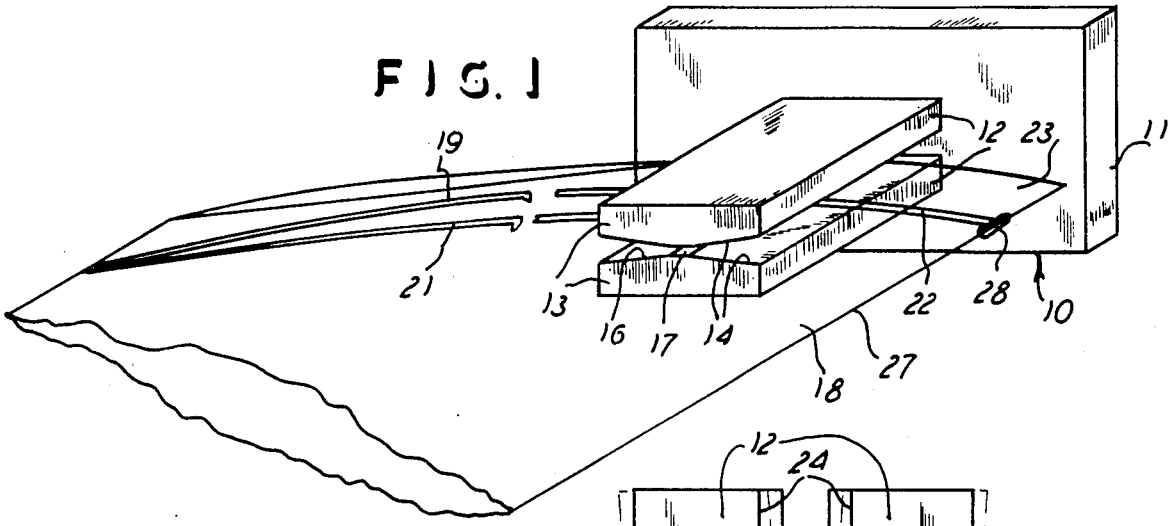
FIG. 1 is a front perspective view of one embodiment of this invention, showing a fragment of a plastic bag inserted therein.
Figure 2:
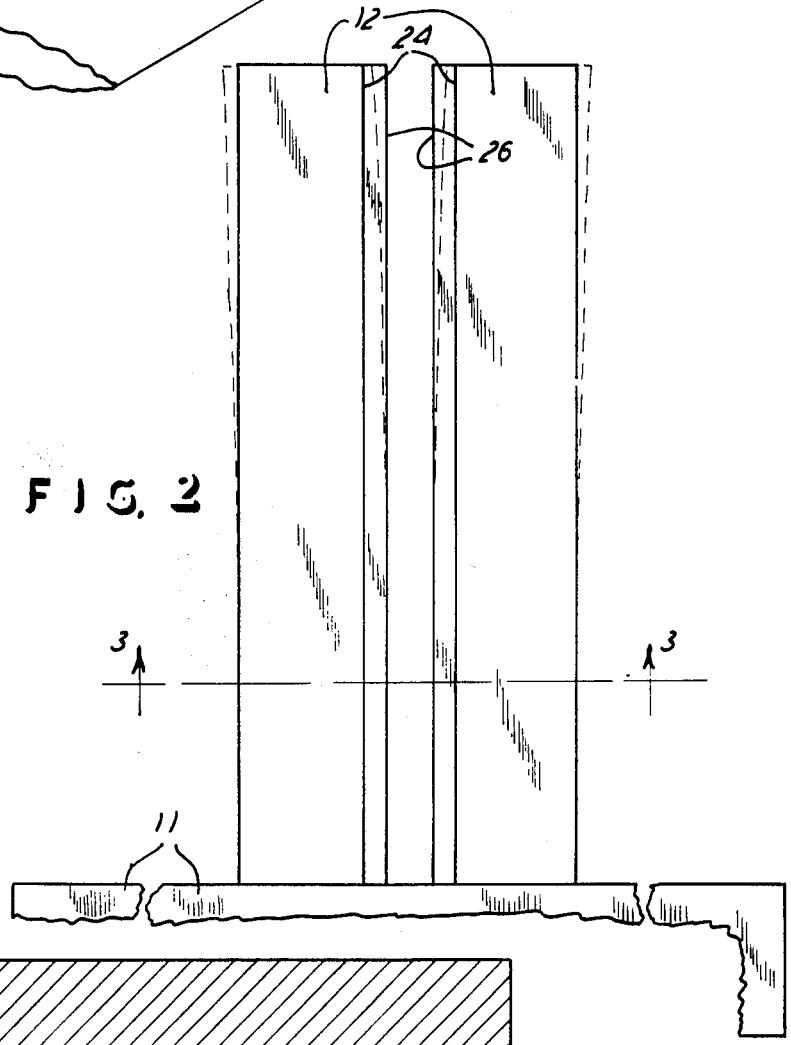
FIG. 2 is an enlarged side elevational view of a fragment of FIG. 1.

Within this context, FIG. 1. shows a device, generally designated 10, having a base member or portion 11 and two arms 12 integral therewith and extending therefrom in cantilever fashion to have free ends 13. The arms 12 present spaced-apart surfaces 14 which are faced toward each other and each of which has a first portion 16 and a second portion 17, both of which portions 16 and 17 are planar, and they are mirror images or directly opposite similar portions 16 and 17 on the other of the two arms 12. The arms 12 are completely spaced-apart throughout their lengths, as shown in FIG. 2, and thus a plastic bag 18 can be slid between the arms for the sealing purpose. The bag 18 is of a conventional arrangement having the tongue-and-groove sealing strips which can include the tongue 19 and the groove 21, of a conventional design, and of course the device 10 urges the tongue-and-groove together into mating contact for sealing, such as along the bag portion designated 22 on the right of the device 10, as viewed in FIG. 1. It is also significant to notice that the conventional bag has an extending end portion 23 which protrudes beyond the sealing strips 22, and the device 10 accomodates this end strip 23 by providing the space between the arms 12 so that the bag can be freely and fully positioned between the arms 12 to be slid rightwardly, as viewed in FIG. 1, for the joining of the sealing strips.

Thus, as shown in FIG. 2, the arms 12 have the maximum gap or dimension between the edge portions 24, and they present the minimum dimension or gap between the surfaces 26. It is of course at the surfaces 26 that the sealing strips 19 and 21 are urged into mating contact, and of course the portions 26 are presented by the planar and flat surfaces previously described and designated 17. Thus, the edge 27 of the bag 18 can be inserted in the maximum dimension 24 on the left of the arms 12, as viewed in FIG. 1, and that edge 27 can then be drawn rightwardly, such as to the position shown in FIG. 1, and therebeyond, for purposes of forming the mated sealing strips 22. Further, in this consideration, it should be seen and understood that the conventional bag 18 has an enlarged portion 28 at its edge 27, such as resulting from the thermal plastic forming of the bag 18, and this enlarged portion 28 can be accomodated in the maximum gap 24, and it can readily be wedged through the minimum gap 26 since the arms 12 are slightly elastic to move away and toward each other to the parallel or set positions. Also, with the elasticity of the arms 12, bags having different thicknesses of the sealing strips 22 can be accomodated between the arms 12, since the arms will simply move apart for a thicker strip 22 but yet force the tongue-and-groove 19 and 21 into the desired mating relationship. FIG. 2 shows, in dotted lines, the elasticity of the arms 12 when subjected to either the enlargement 28 or to a bag having an enlarged or thicker sealing strip 22 then that presented by the minimum distance or gap 26, as mentioned. Of course the minimum distance 26 means that the surfaces 17 are spaced-apart a distance less than the unjoined thickness of the tongue-and-groove 19 and 21, but, the minimum distance or gap 26 is normally spaced-apart the distance equal to the thickness of the joined strips such as 22, to thereby effect the interlocking or joining desired.

As mentioned, the space between the arms 12 beyond the interlocking strips 22 is a slot or gap for receiving the top end 23 of the bag 18, as shown in FIG. 1.

Figure 3:
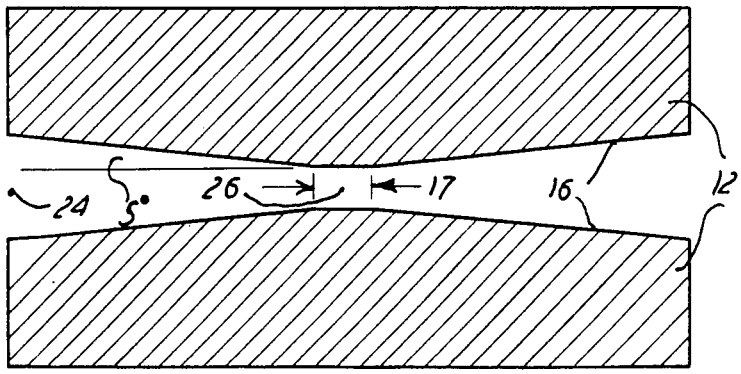
FIG. 3 is an enlarged sectional view taken along the line 3—3 of FIG. 2.

The embodiments shown in FIGS. 4 through 8 can have the same features as mentioned in connection with the embodiments shown in FIGS. 1 through 3, except for the description which follows. FIG. 4 shows the two spaced-apart arms 31 on the back or support portion 11, and they have their surfaces 32 faced toward each other and converging toward each other to the center location in a line relationship at 33. Thus, the embodiment in FIG. 4 shows the maximum dimension at the left and right edges of the arms 31, and it shows the minimum gap or dimension at the line designated 33 for each of the arms 31.

FIG. 5 shows the device with freely extending arms 34 having parallel surfaces 36 facing each other to present the minimum dimension therebetween. Angled surfaces 35 present the maximum or lead-in dimension 37, so the bag can be inserted between the surfaces 36.

FIG. 6 shows two arcuate arms 38 which also are mounted on base member 39 and extend therefrom in free ends. The arms 38 present the maximum dimension or gap 41, and they also present the minimum dimension or gap 42 therebetween. With all of those arrangements, the bag 18 has a lead-in opening for receiving the bag edge 18 and thus the user can readily insert the bag into the minimum dimension area of each embodiment and then draw the sealing strips 19 and 21 through the minimum gap which thereby urges the sealing strips into interlocked position.

FIGS. 7 and 8 show another embodiment, and this too has the features of the previous embodiments, and, in addition, it has a two-stepped arrangement on the opposed or facing surfaces of its two arms 43. That is, the arms 43 have two facing portions 44, and they have two other facing portions 46. FIGS. 7 and 8 clearly show that the portions 44 are spaced-apart further than the portions 46, and thus the embodiment accomodates bags having interlocking strips at least two different thicknesses, namely, the thickness for the surfaces 44 and the thinner thickness for the surface 46.

Therefore, where a bag with a thick sealing strip is used, the strip would be inserted to line up with surfaces 44; and where a bag with a thin sealing strip is used, the strip would be inserted to line up with surfaces 46. In both instances, the device accomodates the bag's end 23 without folding it. Again, the arms 43 also have a gap or slot at the inner ends, such as designated 48 in FIG. 8, for receiving the bag end 23, as mentioned in connection with FIG. 1, and also as provided in the other embodiments hereof. In the use of the embodiment in FIGS. 7 and 8, the operator will simply line up the bag sealing strip 22 with either the gap 44 or the gap 46, whichever gap is appropriate for that particular thickness of bag sealing strip, and, as such, that embodiment is suitable for the bags of at least two different sealing strip thicknesses. In this embodiment, the device is considered to have two stepped surfaces facing each other.

FIGS. 9 and 10 further show the device in the embodiment of two rollers 51 which are then suitably mounted on a block or base 52 to be rotatable, in the directions of rolling contact, and thereby press the bag strips together as previously described. The rollers 51 extend from the block 52, in the cantilever fashion as previously mentioned, and the rollers 51 have two circumferential sizes 54 and 56, in the nature of the stepped surfaces of the previously described embodiment. Therefore, this embodiment in FIGS. 9 and 10 will again accomodate bags of two different thicknesses of sealing strips. Further, a driving motor 57 is shown in driving engagement with the lower roller 51, and then the upper roller 51 would be in the nature of an idler roller, and the bag can be readily fed or drawn between the rollers 51 for the sealing function. In those instances, the minimum gaps are shown at 58 and 59 in FIG. 9, and the maximum dimension or gap would be a distance to the left or right of those minimum distances, as viewed in FIG. 10.

Also, in FIGS. 9 and 10, the upper roller 51 is movable toward and away from the lower roller 51, such as by means of the split 61 in the mounting block 52. An adjusting screw 62 extends across the split 61 and can therefore move the upper roller 51 toward and away from the lower roller 51 for adjusting the gaps 58 and 59 to the desired dimension. Again, contrary to the prior art, these rollers provide for entry of the bag sealing strip 22 between the rollers and at the selected gap either 58 or 59, and also the bag end 23 is accomodated by an extending beyond the rollers 51 and thereby not be folded or bunched to impede the movement of the bag between the rollers 51.

The embodiment shown in FIGS. 11 through 14 consists of a device with two spaced-apart members or arms 63 which are shown to be adjoined with each other through two side members 64. Of course the entire unit can be made of one integral piece of material to have the configuration and features described. That is, there could be one piece of material presenting the arms 63 and the members 64. In any event, the arms 63 present the two spaced-apart surfaces 66 and the contiguous spaced-apart surfaces 67 which are shown parallel to each other. That is, the surfaces 66 are shown angled to each other to present the maximum dimension or gap 68 and the minimum dimension or gap 69. The surfaces 67 are then available for receiving the bag extended portion 23 as described in connection with FIG. 1.

With the embodiment as shown in FIG. 11, the surfaces 66 are converging toward each other, from the outer edge 71 of the member or members 63, and to the point of joining and merging with the surfaces 67. Additionally, as best seen in FIGS. 13 and 14, the surfaces 66 have the angulated portions 72 which extend along the entire lengths of the surfaces 66 and which extent to a line contact 73 between the two mirror image surfaces 72 on each of the surfaces 66. As such, the surfaces 66 have compound angles, namely, the angles denoted by the portions or surfaces 72 which meet at the line 73, and then the surfaces 66 converge toward each other at the second angle in the extent from the outer edge 71, as best seen in FIG. 11. With that arrangement, the device can accomodate bags of varying thickness across the sealing strips in that the user would insert the bag to the extent that the strip thickness would engage both the opposite surfaces 66 in snug contact, and then additional sliding of the bag through the slot or gap would cause the bag to become sealed. Still further, as seen in FIGS. 12 and 13, the thickness of the member or members 63, as defined by the side walls 74, is thin, and not more than three times the maximum gap 68. With that arrangement, the user can hold the bag 18 at its edge 27 and also at another location inwardly on the bag, and thereby feed the bag 18 into the gap 68 until the sealing strips abut the surfaces 66, and thereby the operator can guide the bag into the slot or gap with two hands to assure proper and full positioning of the bag to the desired so-called minimum dimension which effects the joining or sealing of the bag strips 19 and 21.

The embodiment in FIG. 15 shows the use of two arms 76 and 77, and the arms 77 may be fixedly mounted on a support 78, and the arm 76 may be pivoted on a pin 79 on the support 78. Further, the arm 76 is under the influence of a compression spring 81 which bears downwardly on the arm 76 to urge it toward the arm 77. Two semi-circular and elongated protrusions 82 extend along the arms 76 and 77 and are faced toward each other, and the bag 18 can be positioned between the arms 76 and 77 with the sealing strip 22 abutting the cylindrical projections 82 which thereby force the sealing strips into interlocked relationship when the bag is moved between the arms 76 and 77. In that embodiment the device is therefore arranged with a spring member for urging the arms toward each and thereby effect the sealing action.

What is claimed is:

1. A device for joining together the mating sealing strips of a tongue-and-groove type bag, comprising a planar extending base portion, two arms extending in cantilever mounting from said base portion to extend therefrom in the direction transverse to the plane of said base portion, each of said arms having a surface thereon spaced from and facing said surface on the opposite one of said arms to thereby present two spaced-apart and mutually facing surfaces with a gap therebetween, said surfaces being disposed to be spaced-apart a maximum dimension at one of the respective edges thereof and being spaced-apart a minimum dimension less than said maximum dimension at a location between said surfaces spaced from said edges, and all being arranged for permitting moving a bag of the tongue-and-groove type parallel to said plane and between said surfaces in the direction from said edges to said location, said maximum dimension being greater than the total thickness of the joined sealing strips of said tongue-and-groove, said minimum dimension being no greater than the thickness of the mated sealing strips of said tongue-and-groove bag, and said arms being of an elastic material for flexing toward and away from each other under the influence of said sealing strips being slid therebetween.

2. The device for joining together the two interlocking strips of a tongue-and-groove type bag as claimed in claim 1, wherein said surfaces are arcuate and disposed to curve away from each other and thereby present said minimum dimension at the location where said curved surfaces are adjacent each other and curve toward each other.

3. The device for joining together the two interlocking strips of a tongue-and-groove type bag, as claimed in claim 1, wherein at least one of said surfaces is formed to have a step to present two levels on said one of said surfaces and thereby present two different minimum dimensions relative to the other of said surfaces for reception of said strips of two different thicknesses at the respective said two levels.

4. The device for joining together the two interlocking strips of a tongue-and-groove type bag, as claimed in claim 1, wherein said surfaces each include respective portions angularly disposed relative to each other and extend to a common line contact between said portions to thereby present an angle between said portions at said minimum dimension for urging said strips into mating relationships.

5. The device for joining together the two interlocking strips of a tongue-and-groove type bag as claimed in claim 4, where said surfaces are of a narrow width which is substantially the same as said maximum dimension, for permitting the user to grip said bag in two spaced-apart locations along said strips for guiding said strips into contact with said surfaces at said minimum dimension.

6. The device for joining together the two interlocking strips of a tongue-and-groove type bag, as claimed in claim 1, wherein one of said surfaces is movable in contact with and away from the other of said surfaces, and a spring operatively associated with said one of said surfaces for yieldingly urging said one of said surfaces into contact with other of said surfaces.

7. The device for joining together the two interlocking strips of a tongue-and-groove type bag, as claimed in claim 1, wherein said two surfaces are on two rollers rotatably mounted adjacent each other and spaced-apart.

8. The device for joining together the two interlocking strips of a tongue-and-groove type bag, as claimed in claim 7, wherein one of said rollers is power driven by power means.

9. The device for joining together the two interlocking strips of a tongue-and-groove type bag, as claimed in claim 7, wherein at least one of said rollers has a circular step thereon for presenting two cylindrical said surfaces at two of said minimal dimensions from the other of said surfaces, for respectively receiving said strips of two different thicknesses between said surfaces and forcing said strips into sealed relationship.

10. The device for joining together the two interlocking strips of a tongue-and-groove type bag, as claimed in claim 1, where said surfaces are of a narrow width which is substantially the same as said maximum dimension, for permitting the user to grip said bag in two spaced-apart locations along said strips for guiding said strips into contact with said surfaces at said minimum dimension.

11. The device for joining together the two interlocking strips of a tongue-and-groove type bag, as claimed in claim 1, wherein said arms are movable toward and away from each other, and an adjustment screw operatively associated with one of said arms from setting said one arm relative to the other of said arms.

* * * * *